US011774219B2

(12) United States Patent
Wang

(10) Patent No.: US 11,774,219 B2
(45) Date of Patent: Oct. 3, 2023

(54) TOY GUN AND TOY GUN ASSEMBLY

(71) Applicant: Chun Wang, Shantou (CN)

(72) Inventor: Chun Wang, Shantou (CN)

( * ) Notice: Subject to any disclaimer, the term of this patent is extended or adjusted under 35 U.S.C. 154(b) by 0 days.

(21) Appl. No.: 18/099,992

(22) Filed: Jan. 23, 2023

(65) Prior Publication Data

US 2023/0152060 A1 May 18, 2023

(51) Int. Cl.
*F41G 3/26* (2006.01)

(52) U.S. Cl.
CPC ..... *F41G 3/2655* (2013.01)

(58) Field of Classification Search
CPC ..... A63H 29/22; A63H 31/08; F41B 11/89; F41G 3/26; F41G 3/2655; F41A 33/00; F41A 33/02; F41A 33/04; F41A 33/06
See application file for complete search history.

(56) References Cited

U.S. PATENT DOCUMENTS

| | | | | |
|---|---|---|---|---|
| 8,469,824 | B1 * | 6/2013 | Farley | F41J 5/02 434/21 |
| 10,486,078 | B1 * | 11/2019 | Hampton | A63H 33/26 |
| 2010/0071680 | A1 | 3/2010 | Tseng | |
| 2013/0192578 | A1 | 8/2013 | Maeda | |
| 2019/0093977 | A1 | 3/2019 | Kim | |

* cited by examiner

*Primary Examiner* — Timothy A Musselman
(74) *Attorney, Agent, or Firm* — Zhigang Ma

(57) ABSTRACT

A toy gun and a toy gun assembly are provided. The toy gun includes a gun body; a first power supply, a first printed circuit board (PCB), an infrared emitter, a first infrared receiver, a first vibration motor, a trigger, a first display module and a first speaker are arranged in the gun body; the gun body has a gun body portion and a handle portion; the first vibration motor corresponds to the handle portion; and the first display module is exposed from an outer side of the gun body and is disposed towards the upper rear side in a displaying manner.

6 Claims, 8 Drawing Sheets

TOY GUN AND TOY GUN ASSEMBLY

TECHNICAL FIELD

The present disclosure relates to a toy gun and a toy gun assembly.

BACKGROUND

The statements here only provide the background information related to the present disclosure, and do not necessarily constitute the prior art.

With the progress of science and technology, interesting live shooting games have also been introduced into people's entertainment life. There is a competition game "Laser tag". Its rule is roughly as follows: For two or more players in the same area, these players will be divided into two or more teams. The purpose of the game is to eliminate players of other teams from the game. A toy gun used in this game is internally provided with an infrared emitter and usually an infrared receiver. One player of one team aims the gun at another player of the enemy team and pulls the trigger. The trigger activates the infrared emitter on the gun to generate an infrared beam or signal. The infrared signal is transmitted to the infrared receiver (breastplate) of the gun of another player. If the infrared ray is accurately received by the infrared receiver of the enemy's toy, the breastplate will remind the player wearing the breastplate and inform the player that he has been marked or "hit".

Although the existing toy guns and infrared receivers (breastplate) can basically meet the requirements of such game players, there are still some deficiencies that cannot provide better game experience for players.

For example, the existing breastplate reminding manner usually uses a speaker to remind a player of whether he has been hit. By this reminding manner, the player cannot detect it in some special occasions (for example, where the player wears headphones) or because of large environment noise, thus affecting the game experience. Secondly, the game player is intermittently informed of the remaining hit points only through the speaker. For some players, it is not intuitive enough to clearly remember their remaining hit points, which also affects the game experience. At the same time, the layout design of internal structures of some of the existing toy guns is not reasonable enough. As a result, the entire toy gun is not uniform in weight, which leads to a poor grip feeling.

Therefore, it is necessary to study a new technical solution to solve the above problems.

SUMMARY

In order to solve the defects and shortcomings in the prior art, the present disclosure provides a toy gun and a toy gun assembly. By means of designing a toy gun and a toy gun assembly, the toy gun has an infrared emitting function and an infrared receiving function, and a handle portion can be vibrated by a vibration motor to provide a feedback to a player. Meanwhile, the handle portion of a gun body is vibrated, so that the player can learn more sensitively of being hit.

In order to achieve the above-mentioned objective, the present disclosure adopts the following technical solution:

A toy gun includes a gun body, wherein a first power supply, a first printed circuit board (PCB), an infrared emitter, a first infrared receiver, a first vibration motor, an trigger, a first display module and a first speaker are arranged in the gun body; the first PCB is electrically connected with the first power supply, the infrared emitter, the first infrared receiver, the first vibration motor, the trigger, the first display module and the first speaker;

the infrared emitter is disposed towards a front side in an emission manner; the gun body has a gun body portion and a handle portion; a front end of the handle portion is provided with a trigger hole; the first vibration motor corresponds to the handle portion; the trigger corresponds to the trigger hole; and the first display module is exposed from an outer side of the gun body and is disposed towards the upper rear side in a displaying manner.

In some embodiments, decorative strips disposed along an extending direction of the gun body portion are arranged on left and right sides of the gun body; the decorative strips are made of a light-transmitting material; the gun body is provided with LEDs corresponding to the decorative strips; and the first PCB is electrically connected with the LEDs.

In some embodiments, the first power supply is a storage battery; the gun body portion is provided with a first battery compartment for mounting the storage battery; and the first battery compartment is arranged on a lower middle side of the gun body portion.

In some embodiments, the first display module is a digital display screen.

In some embodiments, the first PCB is electrically connected with a loading button; and the loading button is arranged on a lower end surface of the handle portion.

In some embodiments, the gun body includes a shell made of plastic; and the first power supply, the first PCB, the infrared emitter, the first infrared receiver, the first vibration motor, the trigger, the first display module and the first speaker are all arranged in the shell.

A toy gun assembly includes a toy gun and a breastplate, wherein the toy gun is the foregoing toy gun, wherein the breastplate includes a breastplate body; a second PCB, a second infrared receiver, a second display module, a second power supply, a second speaker and a second vibration motor are arranged in the breastplate; and the second PCB is electrically connected with the second infrared receiver, the second display module, the second power supply, the second speaker and the second vibration motor.

The breastplate body is provided with a connection hole for connecting a strap; and the second display module is located on a front side of the breastplate.

Compared with the prior art, the present disclosure has obvious advantages and beneficial effects. Specifically, it can be seen according to the above technical solutions that mainly by means of designing a toy gun and a toy gun assembly, the toy gun has an infrared emitting function and an infrared receiving function, and a handle portion can be vibrated by a vibration motor to provide a feedback to a player. Meanwhile, the handle portion of a gun body is vibrated, so that the player can learn more sensitively that the toy gun has received infrared rays (being hit). In addition, due to the reasonable arrangement of the vibration motor and the battery compartment, the entire toy gun has a uniform weight and a good experience. Furthermore, due to the decorative strips and the loading button, the appearance of the toy gun can also be improved, and game's operations are more lifelike.

In order to describe the structural features and effects of the present disclosure more clearly, the present disclosure is described in detail below in combination with the accompanying drawings and specific embodiments.

REFERENCE NUMERALS IN THE DRAWINGS

10: gun body; 101: left shell; 102: right shell; 11: gun body portion; 12: handle portion; 13: trigger hole; 14: decorative strip; 141: LED; 15: reminder lamp; 16: loading button; 20: first PCB; 21: infrared emitter; 22: first infrared receiver; 23: first vibration motor; 24: trigger; 25: first display module; 26: first speaker; 27: first power supply; 30: breastplate body; 31: connection hole; 32: second battery compartment; 40: second PCB; 41: second infrared receiver; 42: second display module; 44: second speaker; and 45: second vibration motor.

DETAILED DESCRIPTION OF THE EMBODIMENTS

The technical solutions in the embodiments of the present disclosure will be clearly and completely described below in conjunction with the accompanying drawings. Apparently, the described embodiments are only preferred embodiments of the present disclosure.

It should be noted that when an element is referred to as being "fixed" to another element, it can be directly on the other element or an intermediate element may also exist. When one element is considered to be "connected" to another element, it can be directly connected to another element or there may be a central element at the same time. The terms "perpendicular", "horizontal", "left", "right" and similar expressions used herein are for illustrative purposes only, and are not meant to be the only implementation modes.

Unless otherwise defined, all technical and scientific terms used herein are the same as meanings of general understandings of those skilled in the art of the present disclosure. The terms used in the description of the present disclosure herein are merely to describe the specific implementation modes, not intended to limit the present disclosure. The term "and/or" used herein includes any and all combinations of one or more related listed items.

Figure 1:
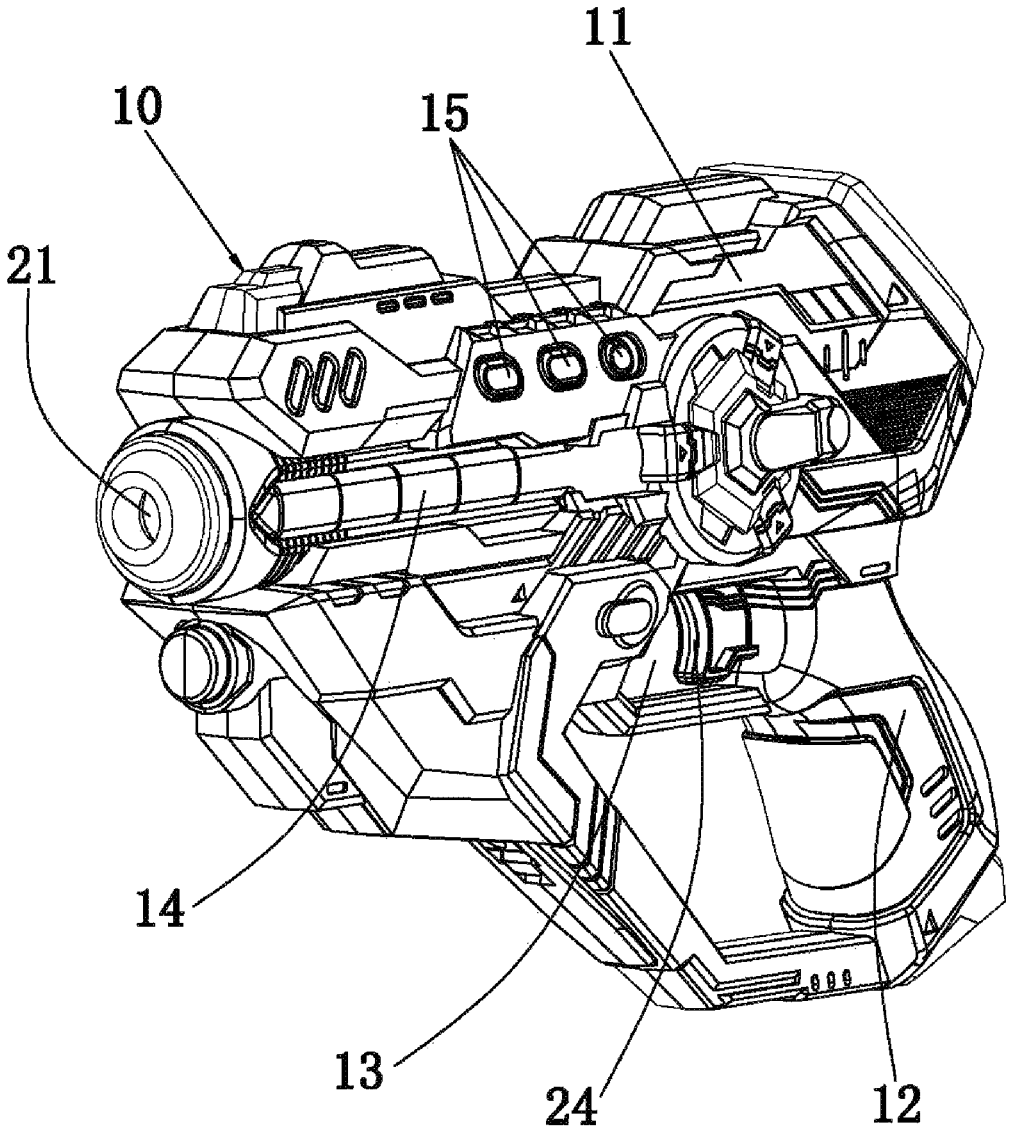
FIG. 1 is a schematic three-dimensional diagram of a toy gun in an embodiment of the present disclosure.
Figure 2:
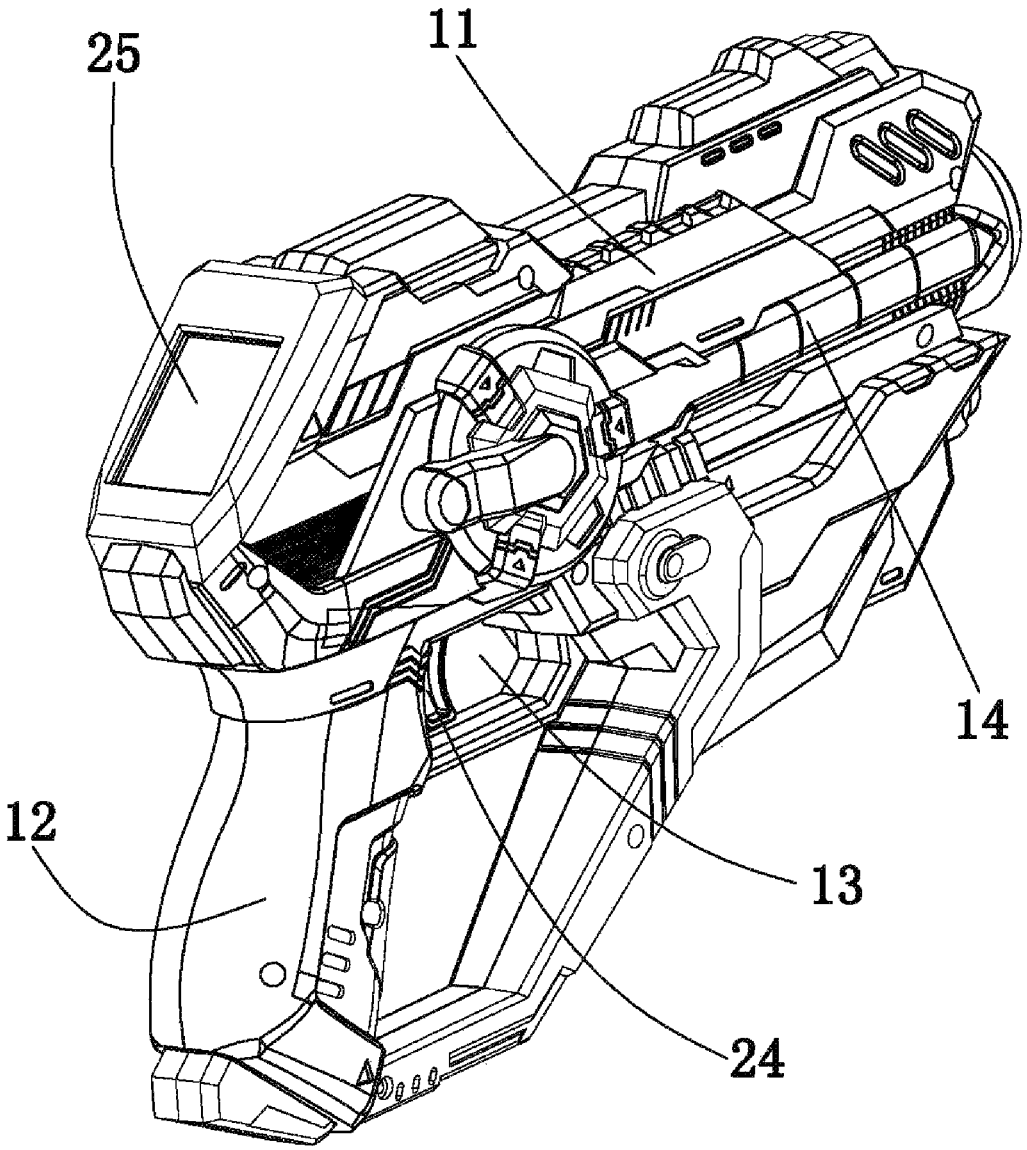
FIG. 2 is a schematic three-dimensional diagram of a toy gun in an embodiment of the present disclosure in another angle.
Figure 3:
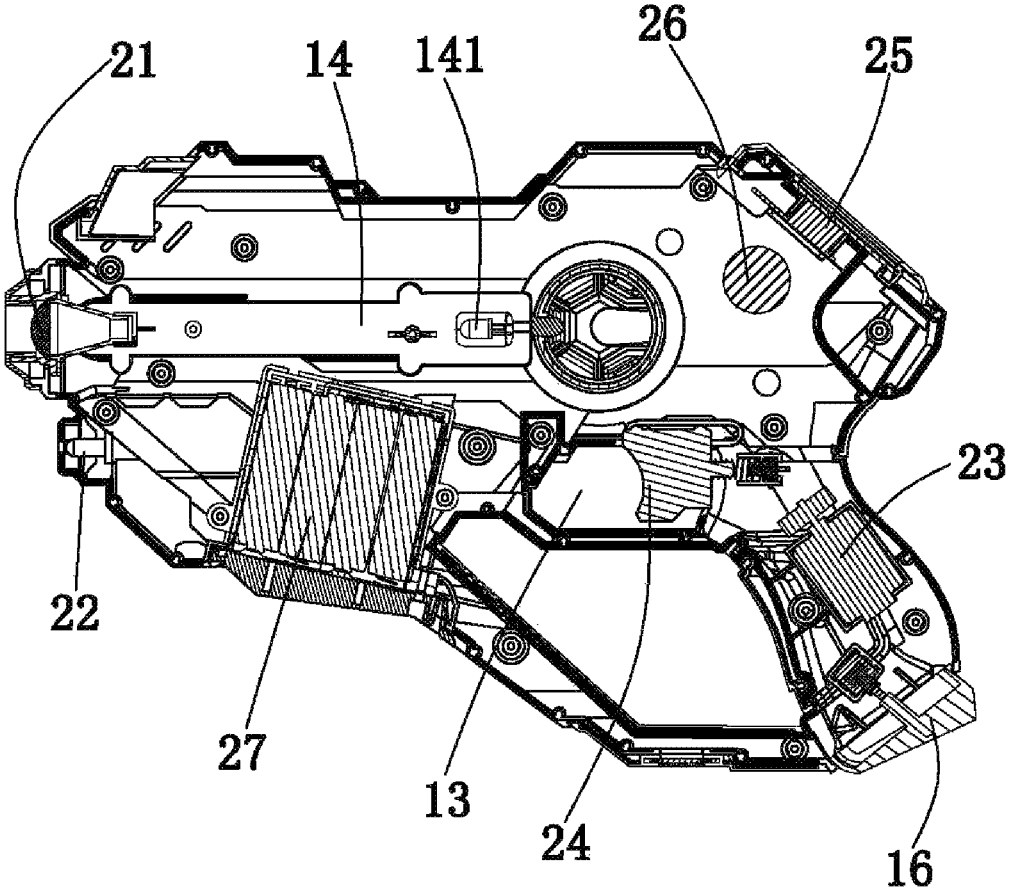
FIG. 3 is a schematic sectional diagram of a toy gun in an embodiment of the present disclosure.
Figure 4:
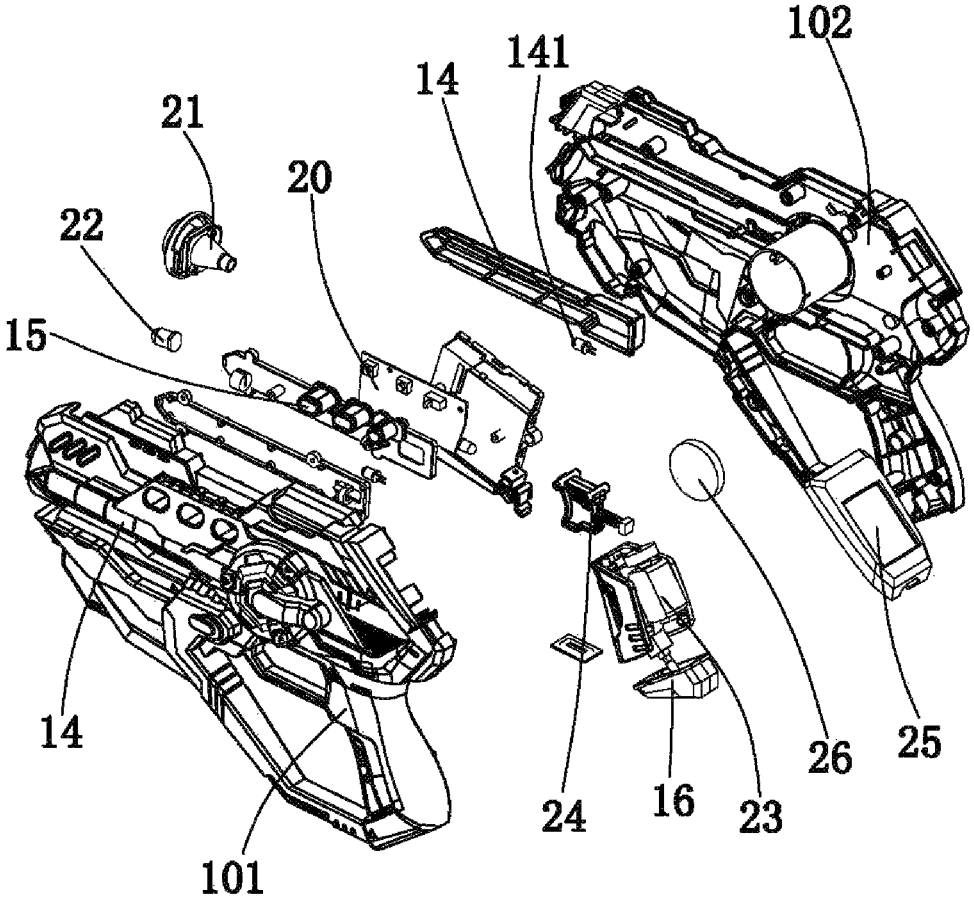
FIG. 4 is a schematic exploded diagram of a toy gun in an embodiment of the present disclosure.
Figure 5:
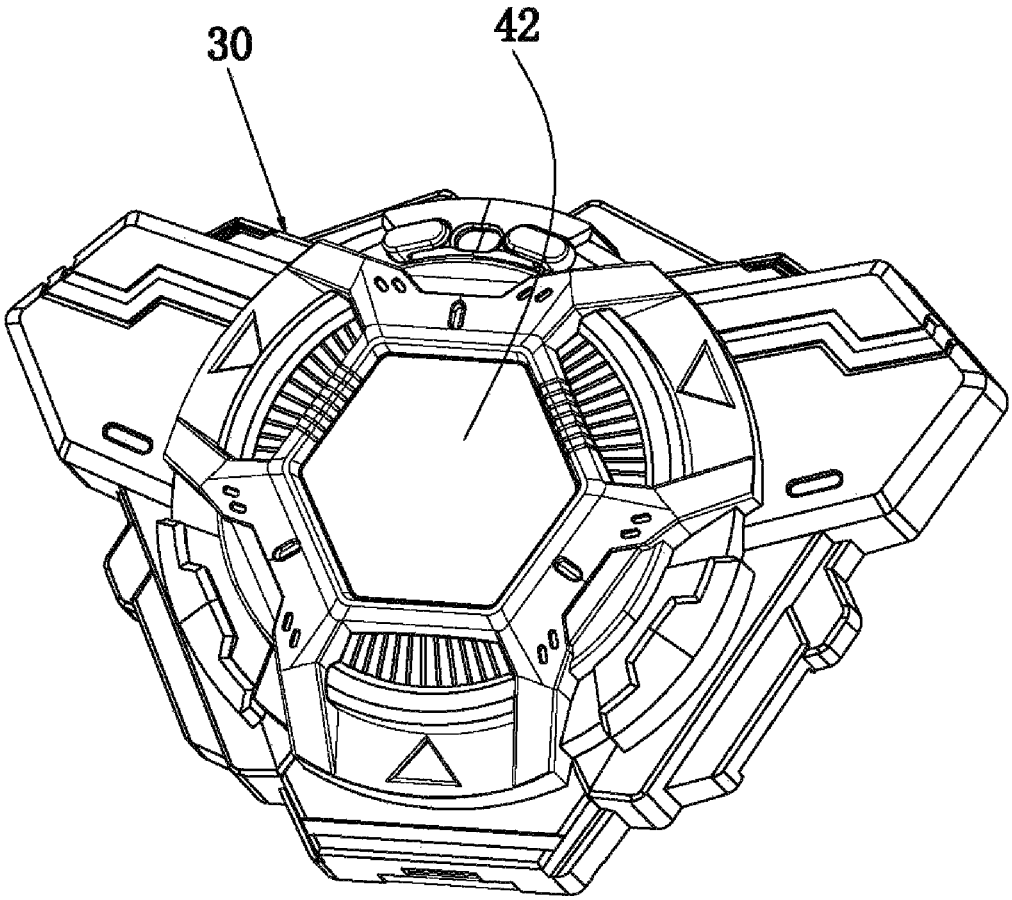
FIG. 5 is a schematic three-dimensional diagram of a breastplate in an embodiment of the present disclosure.
Figure 6:
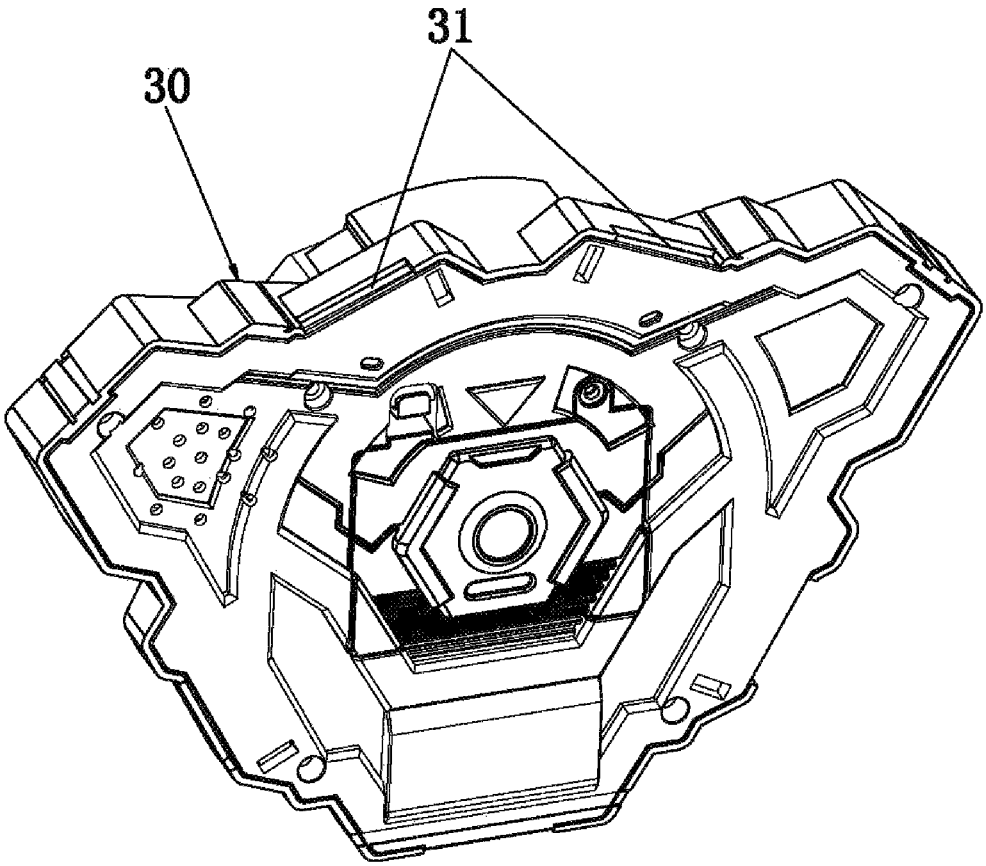
FIG. 6 is a schematic three-dimensional diagram of a breastplate in an embodiment of the present disclosure in another angle.
Figure 7:
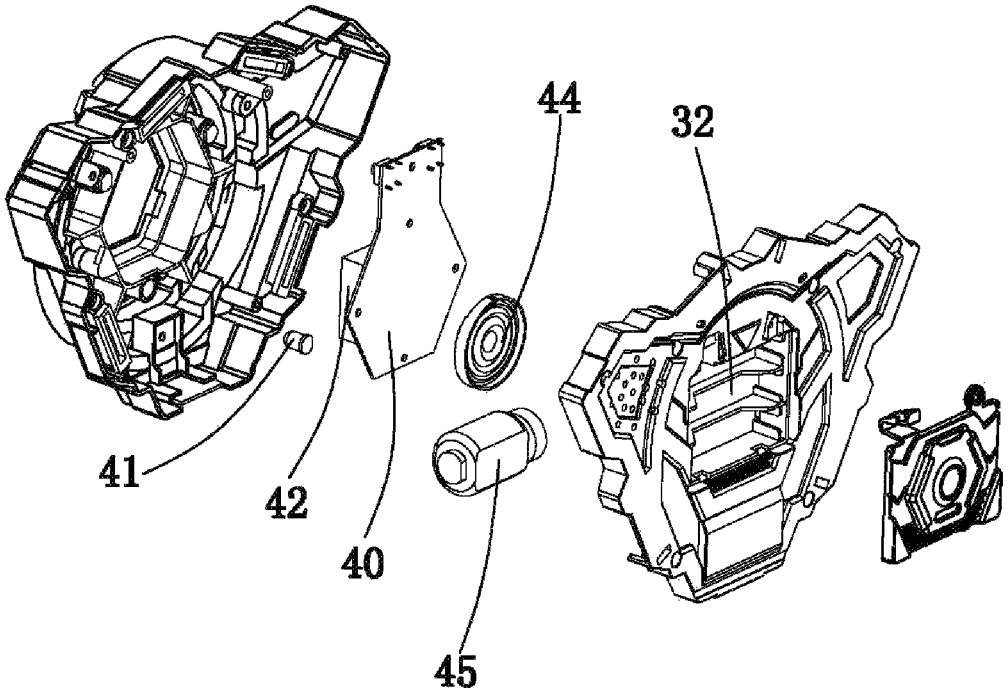
FIG. 7 is a schematic exploded diagram of a toy gun in an embodiment of the present disclosure.
Figure 8:
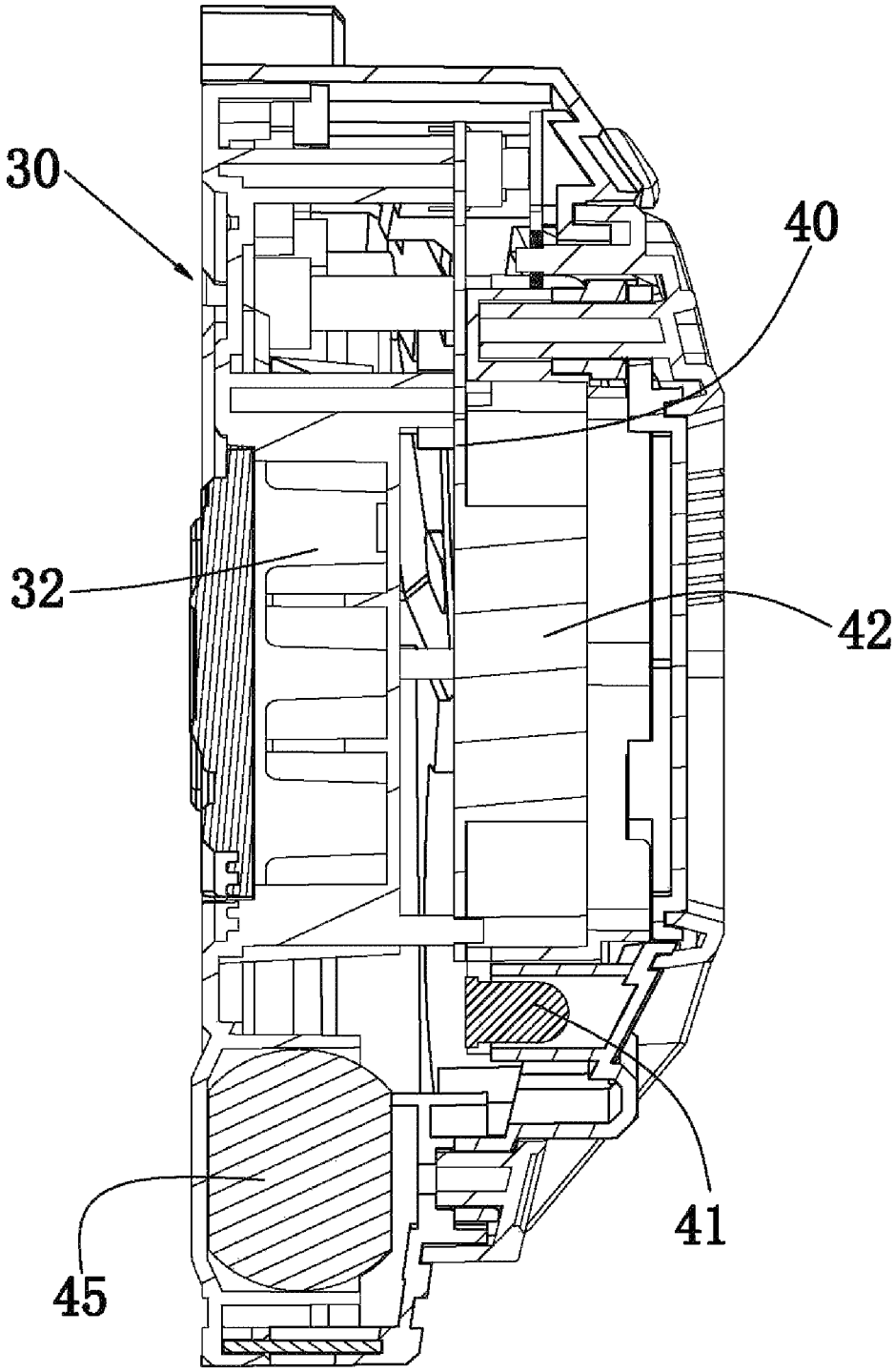
FIG. 8 is a schematic sectional diagram of a toy gun in an embodiment of the present disclosure.

Referring to FIG. 1 to FIG. 8, a toy gun and a toy gun assembly in the embodiments of the present disclosure are provided. The toy gun includes a gun body 10. A first power supply 27, a first PCB 20, an infrared emitter 21, a first infrared receiver 22, a first vibration motor 23, a trigger 24, a first display module 25 and a first speaker 26 are arranged in the gun body 10. The first power supply 27, the infrared emitter 21, the first infrared receiver 22, the first vibration motor 23, the trigger 24, the first display module 25 and the first speaker 26 are all electrically connected with the first PCB 20.

The infrared emitter 21 is disposed towards a front side in an emission manner. The gun body 10 has a gun body portion 11 and a handle portion 12. A front end of the handle portion 12 is provided with a trigger hole 13. The first vibration motor 23 corresponds to the handle portion 12. The trigger 24 corresponds to the trigger hole 13. The first display module 25 is exposed from an outer side of the gun body 10 and is slantways disposed towards the upper rear side in a displaying manner.

The first infrared receiver 22 is disposed towards a front side in a receiving manner. When the trigger 24 is pulled, the first PCB 20 controls the infrared emitter 21 to emit infrared rays towards the front side.

When the first infrared receiver 22 collects infrared rays emitted from other components (other toy guns), the first PCB 20 controls the first vibration motor 23 to vibrate the handle portion 12 to remind the player. Meanwhile, the first PCB 20 can control the first speaker 26 to make a sound to remind the player.

Further, decorative strips 14 disposed along an extending direction of the gun body portion 11 are arranged on left and right sides of the gun body 10. The decorative strips 14 are made of a light-transmitting material. The gun body 10 is provided with LEDs 141 corresponding to the decorative strips 14. The first PCB 20 is electrically connected with the LEDs 141. By means of the arrangement of the decorative strips 14, the appearance effect of a product can be further enhanced, and the market competitiveness of the product can be improved.

During practical application, the first PCB 20 is also electrically connected with several control buttons 15. Different control buttons control different functions. These control buttons 15 include but are not limited to a team selection button, a power switch button, and a weapon selection button (which can adjust the toy gun to a single-shot mode, a plasma gun mode, a machine gun mode and the like). Further, the toy gun is also provided with a loading button 16 for simulating loading. Of course, more functional buttons can be set according to a game need. Preferably, the loading button 16 is arranged on a lower end surface of the handle portion 12.

Further, the first power supply 27 is a storage battery (such as battery AA). The gun body portion 11 is provided with a first battery compartment for mounting the storage battery. The first battery compartment is arranged on a lower middle side of the gun body portion 11. In this way, by means of the reasonable arrangement of the first battery compartment and the first vibration motor 23, the entire toy gun of the present disclosure has a uniform weight, which is convenient for holding and use for play.

Specifically, the first display module 25 is a digital display screen, which can be used for displaying remaining hit points of a player.

Generally, the gun body 10 includes a left shell 101 and a right shell 102 which are made of plastic. The left shell 101 and the right shell 102 are combined to form a mounting cavity. The first power supply 27, the first PCB 20, the infrared emitter 21, the first infrared receiver 22, the first vibration motor 23, the trigger 24, the first display module 25 and the first speaker 26 are all arranged in the mounting cavity.

This embodiment further discloses a toy gun assembly, including a toy gun and a breastplate. The toy gun is the foregoing toy gun. The breastplate includes a breastplate body 30. A second PCB 40, a second infrared receiver 41, a second display module 42, a second power supply, a second speaker 44 and a second vibration motor 45 are arranged in the breastplate 30. The second PCB 40 is electrically connected with the second infrared receiver 41, the second display module 42, the second power supply, the second speaker 44 and the second vibration motor 45.

The breastplate body 30 is provided with a connection hole 31 for connecting a strap; and the second display module 42 is located on a front side of the breastplate 30.

In practical applications, the connection hole 31 is connected with a strap for a player to wear. A front side of the second infrared receiver 41 achieves receiving. When the second infrared receiver 41 of the breastplate receives the infrared rays emitted from the toy gun, the second PCB 40 controls the first speaker 26 to make a sound to remind the player and controls the second vibration motor 45 to vibrate to remind the player. At the same time, the second PCB 40 also controls the second display module 42 to display the remaining hit points of the player. Specifically, the second display module 42 is usually a digital tube.

Preferably, the breastplate is also provided with a reminder lamp 15. The second PCB 40 is connected to the reminder lamp 15 in a control manner. When the second infrared receiver 41 receives the infrared rays emitted from the toy gun, the second PCB 40 controls the reminder lamp 15 to flash for a certain time. When the hit point is 0, the reminder lamp 15 goes out (a specific light reminder method can also be correspondingly adjusted according to a game need). In practical applications, the second PCB 40 is also electrically connected with a team selection setting button, a switch button, and other buttons in a control manner.

The second power supply is usually also a storage battery (such as battery AA), and the breastplate body 30 is provided with a second battery compartment 32 for mounting the storage battery.

It should be added that the first display module 25 and the second display module 42 can be both used for displaying the remaining hit points of the player.

The key point of the design of the present disclosure is that mainly by means of designing a toy gun and a toy gun assembly, the toy gun has an infrared emitting function and an infrared receiving function, and a handle portion can be vibrated by a vibration motor to provide a feedback to a player. Meanwhile, the handle portion of a gun body is vibrated, so that the player can further learn that the toy gun has received infrared rays (being hit). In addition, due to the reasonable arrangement of the vibration motor and the battery compartment, the entire toy gun has a uniform weight and a good experience. Furthermore, due to the decorative strips and the loading button, the appearance of the toy gun can also be improved, and game's operations are more lifelike.

The above descriptions are only preferred embodiments of the present disclosure, and do not limit the technical scope of the present disclosure. Therefore, any minor changes, equivalent changes and modifications made to the above embodiments according to the technical essence of the present disclosure still fall within the scope of the technical solutions of the present disclosure.

What is claimed is:

1. A toy gun assembly, comprising a toy gun and a breastplate, wherein the breastplate comprises a breastplate body; a second PCB, a second infrared receiver, a second display module, a second power supply, a second speaker and a second vibration motor; the second PCB is electrically connected with the second infrared receiver, the second display module, the second power supply, the second speaker and the second vibration motor;

and the breastplate body is provided with a connection hole for connecting a strap;

and the second display module is located on a front side of the breastplate;

wherein the toy gun comprises a gun body, wherein a first power supply, a first printed circuit board (PCB), an infrared emitter, a first infrared receiver, a first vibration motor, a trigger, a first display module and a first speaker are arranged in the gun body; the first PCB is electrically connected with the first power supply, the infrared emitter, the first infrared receiver, the first vibration motor, the trigger, the first display module and the first speaker; the infrared emitter is disposed towards a front side in an emission manner; the gun body has a gun body portion and a handle portion; a front end of the handle portion is provided with a trigger hole; the first vibration motor corresponds to the handle portion; the trigger corresponds to the trigger hole; and the first display module is exposed from an outer side of the gun body and is disposed towards the upper rear side in a displaying manner.

2. The toy gun assembly according to claim 1, wherein decorative strips disposed along an extending direction of the gun body portion are arranged on left and right sides of the gun body; the decorative strips are made of a light-transmitting material; the gun body is provided with LEDs corresponding to the decorative strips; and the first PCB is electrically connected with the LEDs.

3. The toy gun assembly according to claim 1, wherein the first power supply is a storage battery; the gun body portion is provided with a first battery compartment for mounting the storage battery; and the first battery compartment is arranged on a lower middle side of the gun body portion.

4. The toy gun assembly according to claim 1, wherein the first display module is a digital display screen.

5. The toy gun assembly according to claim 1, wherein the first PCB is electrically connected with a loading button; and the loading button is arranged on a lower end surface of the handle portion.

6. The toy gun assembly according to claim 1, wherein the gun body comprises a shell made of plastic; and the first power supply, the first PCB, the infrared emitter, the first infrared receiver, the first vibration motor, the trigger, the first display module and the first speaker are all arranged in the shell.

* * * * *